US005167136A

United States Patent [19]

Pietrantoni et al.

[11] Patent Number: 5,167,136

[45] Date of Patent: Dec. 1, 1992

[54] THREAD ROLL ATTACHMENT

[75] Inventors: Liberato Pietrantoni; Paul P. Francia, both of Rochester, N.Y.

[73] Assignee: C. J. Winter Machine Works, Inc., Rochester, N.Y.

[21] Appl. No.: 743,442

[22] Filed: Aug. 9, 1991

[51] Int. Cl.[5] ..... B21H 03/04

[52] U.S. Cl. ..... 72/101; 72/104; 72/108

[58] Field of Search ..... 72/101, 103, 104, 108

[56] References Cited

U.S. PATENT DOCUMENTS 2,694,322 11/1954 Nell ..... 72/95
2,974,550 3/1961 Eigenbrode ..... 72/101
3,439,518 4/1969 Burnett ..... 72/104

*Primary Examiner*—Lowell A. Larson
*Attorney, Agent, or Firm*—Shlesinger, Fitzsimmons & Shlesinger

[57] ABSTRACT

Each of the two, pivotal, roll supporting arms of a thread rolling attachment has therethrough adjacent the end thereof remote from its pivotal axis a bore in which one end of a cylindrical pattern roll supporting shaft is adjustably secured. The axis of the bore, and hence the axis of the shaft and the pattern roll mounted thereon, are inclined slightly to the pivotal axis of the roll supporting arm, so that the axis or rotation of the pattern roll will be inclined slightly to the axis of rotation of the stock which is to be engaged by the roll. The pattern roll is releasably attached to one end of the support shaft, and is drivingly connected to one end of an internal pin, which is mounted intermediate its ends for rotation in an axial bore which is formed through the support shaft. At its opposite end the pin is releasably connected to a roll gear to which rotation is imparted by the pin upon rotation of the pattern roll. Means are provided for securing the supporting shaft against rotation in its supporting arm, and for adjusting slightly the axis of inclination of the support shaft relative to the axis of the rotating stock.

7 Claims, 2 Drawing Sheets

THREAD ROLL ATTACHMENT

BACKGROUND OF THE INVENTION

This invention relates to thread roll attachments for screw thread machines and the like, and more particularly to attachments having improved means for releasably and adjustably mounting thread rolls on the attachments. More specifically, this invention relates to an improved method and means for rolling tapered pipe threads onto stock, and for manually adjusting the rotational axes of its thread rolls.

The U.S. Pat. No. 4,617,816, which is owned by the same company to which this application has been assigned, discloses a thread rolling attachment of the type with which this invention is generally concerned. An attachment of the type disclosed in the above-noted patent includes a pair of thread roll supporting arms, which are pivotally mounted intermediate their ends on a yoke, to be forced into rolling engagement with the opposite sides of a piece of rotating bar stock in order to form threads in the stock. The arms are actuated by a wedge element which is manipulated by a fluid pressure operated piston.

Typically, thread rolls are bound to supporting arms which place the rotational axes of the thread rolls parallel to and within the same plane as the longitudinal axis of the stock. This arrangement proves to be inadequate when tapered stock surfaces are encountered, because a similarly tapered thread roll must be employed in order to maintain the parallel axes. It has heretofore been customary to match the diametrally larger end of the thread roll to the diametrally smaller end of the stock and vice versa. This method however, is plagued by slippage occurring between the stock and thread roll caused by a variation of the rotational velocity along the length of the working surfaces of the thread rolls. Such slippage reduces the quality of threads produced upon the tapered stock surface.

Accordingly, it is an object of this invention to provide a novel thread roll attachment for producing high quality threads on a circumferentially tapered peripheral stock surface.

Another object of this invention is to provide an improved attachment of the type described which enables both the quick removal of its associated thread rolls, and the adjustment of the axes of the rolls.

Other objects of the invention will be apparent hereinafter from the specification and from the recital of the appended claims, particularly when read in conjunction with the accompanying drawings.

SUMMARY OF THE INVENTION

Each of a pair of pivotal thread roll supporting arms in an outboard attachment for a screw machine carries in a hub at its outer end a non-rotatable, axial bored thread roll support shaft, which projects axially at one end beyond one side of the supporting arm. A thread roll is removably and rotatably mounted coaxially on the projecting end of each thread roll support shaft by the head of an internal pin, which is mechanically connected at one end to the associated thread roll and which projects at its opposite end coaxially through an axial bore in its support shaft. At its opposite end each internal pin is releasably secured to a thread roll drive gear by quick release ball detents, which are controlled by a spring-loaded, cam-action plunger which normally is spring-loaded in an operative position in which rotation of the drive gear is imparted to the internal pin. By the action of a cam device comprising of a pin and slot connection between the internal pin and the plunger, the plunger can be held in a release position in which the ball detents disengage the thread roll drive gear, thereby permitting the thread roll and the internal pin to be removed from the support shaft and supporting arm.

The axis of each thread roll support shaft, and hence the axis of the thread roll thereon, is inclined slightly (e.g. approximately $3\frac{1}{2}°$) to the axis of the stock which is to be threaded. Also each such shaft is adjustable by means of a taper adjusting pin which is mounted in its supporting arm slidably to engage a transverse flat which is formed on the external surface of the support shaft. The taper adjusting pin is movable selectively in opposite directions thereby causing the axis of the thread roll support shaft to pivot in relation to the axis of the bore in which it is mounted.

THE DRAWING

DETAILED DESCRIPTION OF THE PREFERRED EMBODIMENTS

Figure 1:
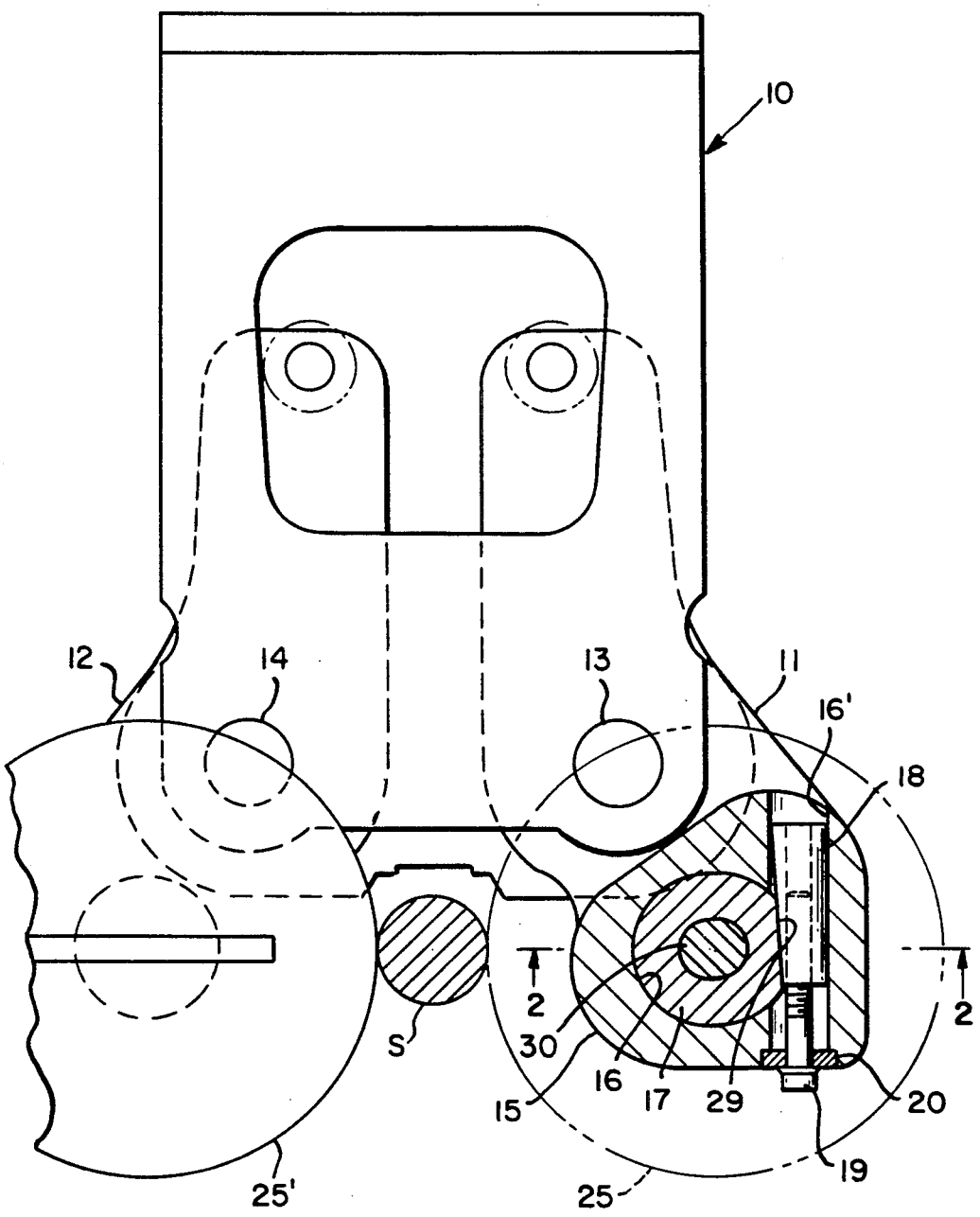
FIG. 1 is an end elevational view of a thread roll attachment made according to one embodiment of this invention, part of the attachment being shown in cross section.

Referring now to the drawings by numerals of reference, and first to FIG. 1, 10 denotes generally a yoke, which may form part of a conventional screw thread machine attachment of the type disclosed in the above-noted U.S. Pat. No. 4,617,816. A pair of roll support arms 11 and 12 are pivotally mounted intermediate their ends on the yoke by means of removable fulcrum pins 13 and 14, respectively. A hub 15 which is formed on the lower end of the arm 11 has therethrough a bore 16 which is inclined slightly (e.g. $3\frac{1}{2}°$) relative to the pivotal axis of arm 11, and which contains a roll support shaft 17. Interposed between the bore 16 and the outer periphery of thread roll support shaft 17 (FIG. 2) adjacent one end thereof, and mounted for axial adjustment in a bore 16' perpendicular to a shaft 17, is a taper adjusting pin 18.

Taper adjusting pin 18 intersects the bore 16 adjacent one diametral side thereof, and has thereon an axially extending, flat camming surface 18' that engages shaft 17 for a purpose noted hereinafter. Pin 18 has an internally threaded bore in which is threaded the shank of a rotatable taper adjusting screw 19, which is fixed against axial movement by a collar 20. Rotation of taper adjusting screw 19 will cause taper adjusting pin 18 to move minutely in either an upward or downward direction in bore 16'. Due to the shape of the camming surface 18', of pin 18 upward or downward (FIG. 1) will, as noted hereinafter, change the inclination of the axis of the support shaft 17 relative of the axis of bore 16. The diameter of bore 16 is slightly greater than the outer diameter of shaft 17, so that adjustment of pin 18 will cause support shaft 17 and its axis 22 to pivot about the shank of a shoulder screw 23 (FIG. 2) that extends transversely into hub 15 on arm 11 to intersect bore 16 at the side of support shaft 17 opposite taper adjusting pin 18. The shank of screw 23 projects into a circumferential groove 24 formed in support shaft 17 adjacent the end thereof remote from pin 18. Pivotal adjustment of shaft 17 about shoulder screw 23 will cause the shaft axis 22, and hence the axis of the thread roll 25 which is thereon, to align with or to incline slightly relative to the axis of bore 16. A set screw 26, which extends radially through support arm hub 15 into bore 16, has its inner end engaged with support shaft 17 opposite pin 18 to stabilize shaft 17 and its thread roll 25 upon adjustment of axis 22.

The outer peripheral surface of thread roll 25 is tapered, so that it has a small end 25S (FIG. 2) and a large end 25L. Therefore, in use, and before engaging the threading roll 25 with the tapered surface 28 of the rotating stock S that is to be threaded, adjustment of the axis 22 will be made in order to align, in parallel, the tapered surface of the thread roll 25 with the tapered surface 28 of the stock S. Support shaft 17 is prevented from rotating by the flat surface 18' on taper adjusting pin 18, which slidably engages a confronting, flattened surface 29 that is cut or ground into the circumferential surface of support shaft 17. When arm 11 swings thread roll 25 into engagement with the rotating stock S, as noted hereinafter, the rotation of stock S is imparted to the thread roll 25.

Figure 2:
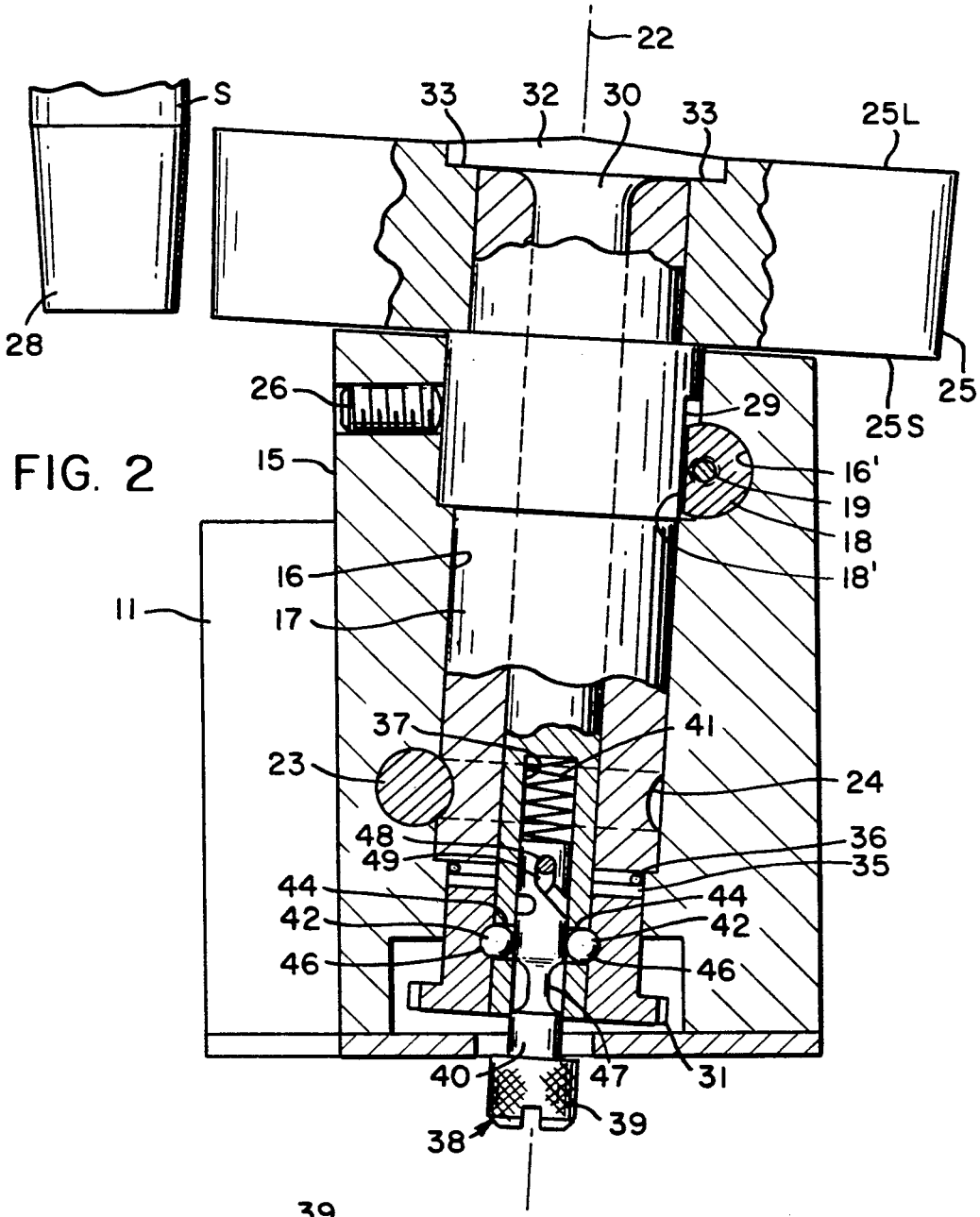
FIG. 2 is an enlarged, fragmentary sectional view taken along the line 2—2 in FIG. 1 looking in the direction of the arrows.

Thread roll 25 is drivingly connected to an internal pin 30, which has a cylindrical shank that extends rotatably and coaxially through an axial bore in support shaft 17. Pin 30 has formed on one end thereof (its outer end as shown in FIG. 2) an elongate, generally rectangularly shaped head or bar 32, which is integral intermediate its ends with pin 30, and which is removably seated at opposite ends thereof in opposed notches or indented seats 33 formed in the outer surface of thread roll 25. Bar 32 thus ensures that the rotation of thread roll 25 will be transferred to the internal pin 30. At its inner end remote from its head 32 the internal pin 30 is releasably secured to a roll gear 31 in a manner noted hereinafter. Surrounding the shank of pin 30 between roll gear 31 and the non-rotatable support shaft 17 are a thrust washer 35 and a thrust needle roller bearing 36, which together allow roll gear 31 to rotate without engaging support shaft 17.

Mounted for limited axial movement within a bore 37, which extends coaxially and part way into the end of internal pin 30 remote from its head 32 is a spring-loaded, cam-action plunger denoted generally as 38. Plunger 38 has an enlarged-diameter head portion 39 which extends beyond one side of arm 11, and a reduced-diameter shank 40 which extends slidably into bore 37. A compression spring 41, which is engaged with the inner end of the plunger shank 40 at the bottom of the bore 37 acts resiliently to maintain plunger 38 in an operating position in which diametrally opposite sides of its shank 40 engage a pair of ball detents 42 which are mounted for limited radial movement in opposed circular openings 44 in the annular wall of pin 30 forming the bore 37. In this position portions of the detents 42 are retained by shank 40 in two correspondingly shaped and diametrally opposed recesses 46 formed in the inner peripheral surface of roll gear 31, whereby detents 42 operatively connect the internal pin 30 to the roll gear 31 for rotation thereby, when gear 31 is driven in a conventional manner.

Figure 3:
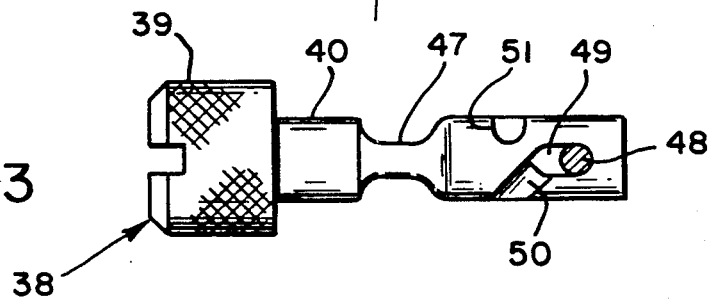
FIG. 3 is an enlarged side elevational view of the cam-action plunger which forms part of this attachment.

In order to release internal pin 30 from roll gear 31, plunger 38 is urged axially inwardly against the resistance of spring 41 for a distance sufficient to align a circumferential recess 47 in the plunger shank 40 with the two diametrally opposed detents 42. In this position both detents 42 are released from recesses 46 of roll gear 31 and engage instead in the circumferential recess 47, thereby removing the barrier against axial movement of internal pin 30. However, in order to remove pin 30 from support shaft 17, the plunger 38 and detents 42 must remain in their non-operational positions. This is achieved by a pin 48 which is secured at opposite ends in registering openings in the annular wall of pin 30 intermediate the ends of its bore 37. Pin 48 extends intermediate its ends through a slot 49 (FIGS. 2 and 3) formed through the shank 40 of plunger 38 adjacent its inner end. Slot 49 communicates with one end of an axially extending, diagonal camming slot 50 (FIG. 3) the opposite end of which, as denoted by numeral 51 in FIG. 3, is displaced nearly 180° from slot 49. As a consequence, when plunger 38 is urged axially inwardly, pin 48 causes the plunger 38 to be rotated approximately 180° whereby the pin 48 becomes seated in the end 51 of camming slot 50, thus retaining plunger 38 in its inner or release position, so that ball detents 42 remain seated in circumferential recess 46 of plunger shank 40. In this position pin 30 can be slidably and axially removed from shaft 17, after which the thread roll 25 can be slid off from the outer peripheral surface of shaft 17.

The outer ends of the circular openings 44 in the annular wall of pin 30 are peaned over slightly, or are otherwise slightly restricted, so that the ball detents cannot fall out of these openings when pin 30 is removed from shaft 17. Thus when another thread roll or pattern roll has been mounted on the projecting end of shaft 17, the pin 30 can be reinserted into shaft 17 and plunger 38 can be rotated or released back to its gear engaging position as shown in FIG. 2.

While the above-noted thread roll mounting means has been described in connection with only one of the support arms 11 and 12, it will be understood that a similar such mechanism could be utilized to mount a thread roll 25' on arm 12, in which case the roll gear associated with roll 25' (not illustrated) will be coupled in conventional manner with gear 31 to assure that rolls 25 and 25' rotate in unison. Although a quick release mechanism for thread rolls has been disclosed in U.S. Pat. No. 4,924,687, owned by the same company to which this application is assigned, the present release mechanism has the advantage that it places the release mechanism at the end of the thread roll support shaft remote from the thread roll itself, whereby less strain will be placed on the small moving parts. A quick release mechanism of the type disclosed in the above-noted U.S. Pat. No. 4,924,687 may be utilized for removably mounting the fulcrum pins 13 and 14 in their respective arms 11 and 12.

From the foregoing it will be apparent that the present invention may be used to accommodate the varying degrees of tapered stock surfaces common to tapered pipe fittings and screw connections.

Moreover, while this invention has been illustrated and described in detail in connection with only certain embodiments thereof, it will be apparent that this application is intended to cover any such modifications as may fall within the scope of one skilled in the art or the appended claims.

We claim:

1. In a thread rolling attachment for an automatic screw machine of the type having thereon a pivotal roll supporting arm, improved means for rotatably supporting a pattern roll on one end of said arm, comprising a support shaft, means for adjustably mounting said support shaft adjacent one end thereof in a bore which is formed in said one end of said arm to extend transversely between opposite sides thereof, and which has a diameter slightly larger than that of said shaft, means supporting an annular pattern roll on the opposite end of said support shaft for rotation coaxially thereof, and for swinging movement by said arm about an axis parallel to the axis of rotation of a piece of rotating stock in said machine, and selectively into and out of rolling contact with said piece of rotating stock, the axis of said bore in said one end of said arm being inclined slightly to the pivotal axis of said arm, whereby the axis of rotation of said pattern roll is inclined slightly to the axis of rotation of said stock, said mounting means including means located adjacent one end of said bore in said arm and defining a fulcrum engaging said shaft at one diametral side thereof, and operative to support said shaft for limited pivotal movement about an adjusting axis which extends transverse to the axis of said bore, and means in said bore adjacent the opposite end thereof including an adjustable camming element engaging the diametrally opposite side of said shaft and operative to secure said shaft against rotation in said bore, and adjustable to effect pivotal adjustment of said shaft in said bore about said fulcrum.

2. In a thread rolling attachment as defined in claim 1, wherein the outer peripheral surface of said thread roll is tapered, whereby the outer diameter of said thread roll at one end thereof is slightly larger than the outer diameter of the thread roll at the opposite end thereof, and said opposite end of said thread roll confronts said arm.

3. In a thread rolling attachment as defined in claim 1, wherein said fulcrum comprises a cylindrical pin secured in said arm transversely of said bore, and having a portion of its periphery extending into an annular recess formed in said shaft coaxially thereof.

4. In a thread rolling attachment as defined in claim 1, wherein said camming element is mounted in said arm for adjustment transversely of said bore, and has thereon a plane camming surface slidably engaged against a flat surface formed on said diametrally opposite side of said shaft adjacent said opposite end of said shaft.

5. In a thread rolling attachment for an automatic screw machine of the type having thereon a pivotal roll supporting arm, improved means for rotatably supporting a pattern roll on one end of said arm, comprising a support shaft, means for adjustably mounting said support shaft adjacent one end thereof in a bore which is formed in said one end of said arm to extend transversely between opposite sides thereof, means supporting an annular pattern roll on the opposite end of said support shaft for rotation coaxially thereof, and for swinging movement by said arm about an axis parallel to the axis of rotation of a piece of rotating stock in said machine, and selectively into and out of rolling contact with said piece of rotating stock, the axis of said bore in said one end of said arm being inclined slightly to the pivotal axis of said arm, whereby the axis of rotation of said pattern roll is inclined slightly to the axis of rotation of said stock, said outer peripheral surface of said thread roll being tapered, whereby the outer diameter of said thread roll at one end thereof is slightly larger than the outer diameter of the thread roll at the opposite end thereof, and said opposite end of said thread roll confronts said arm, said annular pattern roll supporting means comprising an internal pin drivingly connected at one end to said one end of said pattern roll, and extending at its opposite end rotatably and coaxially through an axial bore in said support shaft, a roll gear mounted adjacent said one end of said support shaft for rotation coaxially of said shaft, and means releasably connected said opposite end of said internal pin to said roll gear, whereby said roll gear is operative, when rotated, to cause said pattern roll to be rotated by said internal pin.

6. In a thread rolling attachment as defined in claim 5, wherein said means releasably connecting said opposite end of said internal pin to said roll gear comprises, an annular hub on said roll gear positioned in coaxial, overlapping relation to said opposite end of said internal pin, a plurality of ball detents interposed between said annular hub and said opposite end of said pin for limited radial movement between operative positions in which said detents drivingly connect said annular hub to said opposite end of said pin, and inoperative positions in which said hub is drivingly disconnected from said pin, and a camming plunger mounted for limited axial movement relative to said gear hub and said pin between a first limit position in which said plunger retains said detents in their operative positions, and a second limit position in which said plunger releases said ball detents for movement to their inoperative positions to disconnect said hub from said internal pin.

7. In a thread rolling attachment as defined in claim 6, wherein said annular hub surrounds said opposite end of said internal pin coaxially thereof, said camming plunger has a cylindrical shank mounted for limited axial movement in an axial bore formed in said opposite end of said pin coaxially thereof, said ball detents are mounted for limited radial movement in radial ports formed in said internal pin to communicate at one end with the outer peripheral surface of said pin, and at their opposite ends with the axial bore in said opposite end of said pin, and said cylindrical shank portion of said plunger is operative upon movement of said plunger to its first limit position to urge said ball detents radially outwardly from their inoperative to their operative positions in which segmental spherical portions of said detents are releasably seated in registering, segmental spherical recesses formed in the inner peripheral surface of said annular gear hub, thereby releasably to connect said gear to said pin.

* * * * *